United States Patent [19]

Towe et al.

[11] Patent Number: 5,075,536

[45] Date of Patent: Dec. 24, 1991

[54] HEATING ELEMENT ASSEMBLY FOR GLOW PLUG

[75] Inventors: Carey A. Towe, Peoria; John M. Bailey, Dunlap; Scott F. Shafer; Michael Blanco, both of Peoria, all of Ill.

[73] Assignee: Caterpillar Inc., Peoria, Ill.

[21] Appl. No.: 524,610

[22] Filed: May 17, 1990

[51] Int. Cl.[5] ..... F23Q 7/22

[52] U.S. Cl. ..... 219/270; 219/552; 219/553; 123/298; 123/145 A; 361/266

[58] Field of Search ..... 219/260, 270, 267, 505, 219/523, 553, 268, 242, 237; 123/145 A, 145 R, 298; 361/264, 266

[56] References Cited

U.S. PATENT DOCUMENTS

| | | | |
|---|---|---|---|
| 3,065,436 | 11/1962 | Kayko et al. | 338/243 |
| 3,956,531 | 5/1976 | Church et al. | 427/226 |
| 4,426,568 | 1/1984 | Kato et al. | 219/270 |
| 4,476,378 | 10/1984 | Takizawa et al. | 219/270 |
| 4,502,430 | 3/1985 | Yokoi et al. | 123/145 A |
| 4,548,172 | 10/1985 | Bailey | 123/298 |
| 4,721,081 | 1/1988 | Krauja et al. | 123/298 |
| 4,786,781 | 11/1988 | Nozaki et al. | 219/270 |
| 4,901,196 | 2/1990 | Grzybowski | 361/266 |

FOREIGN PATENT DOCUMENTS

| | | |
|---|---|---|
| 352188 | 3/1961 | Switzerland . |
| 860466 | 2/1961 | United Kingdom . |
| 1094522 | 12/1967 | United Kingdom . |

OTHER PUBLICATIONS

Patent Abstracts of Japan, vol. 7, No. 165 (M-230) (1310) Jul. 20, 1983 & JP-A-58 72821, published Apr. 30, 1983, by S. Nozaki.

Patent Abstracts of Japan, vol. 8, No. 174 (M-316) (1611) Aug. 10, 1984 & JP-A-59 66618, published Apr. 16, 1984, by S. Yokoishi.

U.S. application Ser No. 07/386,064, titled: Interference Connection Between a Heating Element and Body of a Glow Plug, filed Jul. 28, 1989, by Scott F. Shafer.

Exhibit A, by Kyocera Corp.

"The Corrosion of Silicon Based Ceramics in a Residual Fuel Oil Fired Enviroment", by S. Brooks and D. B. Meadowcroft, Proceedings of the British Ceramics Society, 1978, No. 26, pp. 237-250.

Formulas for Stress and Strain, 5th edition, by R. J. Roark & W. C. Young, published 1975, McGraw-Hill Book Company, excerpts pp. 582-585.

U.S. application Ser. No. 07/524,609, titled: Heating Element Assembly for Flow Plug (assignees copending application), filed: May 17, 1990, by: John M. Bailey et al.

*Primary Examiner*—Bruce A. Reynolds
*Assistant Examiner*—Tu Hoang
*Attorney, Agent, or Firm*—Anthony N. Woloch

[57] ABSTRACT

The service life of conventional glow plugs is extremely short when they are continuously energized at an elevated temperature during engine operation in order to assist ignition of non-autoignitable fuels. Such glow plugs typically fail due to thermal stresses and/or oxidation and corrosion. Herein is disclosed an improved heating element assembly adapted for incorporation in a glow plug. The heating element assembly includes a monolithic sheath having a relatively-thin and generally annular wall defining a blind bore. The heating element assembly further includes a heating device positioned in the blind bore and adapted to emit heat, and a heat transfer device adapted to transfer heat from the heating means to the sheath. The heating device is protected by the sheath formed of a preselected material which is chosen and configured so as to minimize failure of the heating element assembly caused by thermal stresses, oxidation and/or corrosion.

37 Claims, 5 Drawing Sheets

HEATING ELEMENT ASSEMBLY FOR GLOW PLUG

TECHNICAL FIELD

The present invention relates generally to glow plugs and, more particularly, to heating element assemblies for such glow plugs.

BACKGROUND ART

Until recent times, the technology of glow plugs, as applied to diesel internal combustion engines, has primarily evolved to satisfy the requirement of merely assisting the startup of such engines. In this application, it is understood that the diesel engines are burning autoignitable fuels.

Such conventional glow plugs are designed to be temporarily energized, by electrical-resistance heating, to a preselected moderately high temperature (for example, about 900° C./1650° F.) only during the brief period of starting. When cranking the engine during startup, atomized fuel sprayed from an injector contacts or passes in close proximity to the hot glow plug and ignition of the fuel is effected primarily by surface ignition. Because the rotational speed of the engine is quite slow during the cranking and startup phase, fuel remains in the vicinity of the glow plug for a relatively long time compared with normal engine operation. Consequently, the ignition of conventional fuel in a relatively cold engine is accomplished even at the above moderately high temperature. Once the engine is started, such glow plugs are deenergized and the engine continues to operate solely by autoignition of the fuel. Consequently, the deenergized glow plugs are allowed to cool down to a lower temperature which is approximately the engine mean cycle temperature (for example, about 675° C./1250° F.) during normal engine operation.

It has also been customary to preheat conventional glow plugs to the moderately elevated temperature prior to cranking and starting of the diesel engine. In commercial vehicles, such as earthmoving tractors or heavy-duty trucks, there used to be little concern about the time required (typically about one to two minutes) for preheating the glow plugs to the moderately elevated temperature. However, the increased application of diesel engines to light-duty trucks and passenger cars in recent years has caused a greater demand on being able to preheat the glow plugs in a much shorter period of time (typically about one to two seconds being considered acceptable). Thus, in recent years, the technological development of glow plugs has also focused on providing temporarily energizable glow plugs which require less time to preheat before the engine is cranked and started.

In response to scarce and dwindling supplies of conventional diesel fuel as well as the environmental need to develop cleaner burning engines, manufacturers have been developing engines which are capable of burning alternative fuels such as methanol, ethanol, and various gaseous fuels. However, such alternative fuels typically have a relatively low cetane number, compared to diesel fuel, and therefore are reluctant to ignite by mere contact with the heat of compressed intake air.

Applicants have been early leaders in the development of ignition-assisted engines which operate on the diesel cycle but which differ from conventional diesel or compression-ignition engines in that the ignition of the injected fuel and propagation of the flame is not effected primarily by the fuel contacting the heat of compressed intake air during normal engine operation. This hybrid type of engine having ignition-assist will hereinafter be generally referred to as a diesel-cycle engine.

As shown in U.S. Pat. No. 4,721,081 issued to Krauja et al. on Jan. 26, 1988 and U.S. Pat. No. 4,548,172 issued to Bailey on Oct. 22, 1985, one way of facilitating ignition of such fuels is to provide an ignition-assist device which extends directly into the engine combustion chamber. For example, the ignition-assist device may include a continuously energized glow plug which is required to operate at a very high preselected temperature throughout engine operation. For example, such very high preselected temperature may be about 1200° C./2192° F. in order to ignite the above mentioned alternative fuels.

Applicants initially tried to use conventional glow plugs in this application. One type of conventional glow plug is generally shown in U.S. Pat. No. 4,476,378 issued to Takizawa et al. on Oct. 9, 1984. This glow plug has a heating element assembly consisting of a wire filament wound as a single helix around a mandrel which is positioned in a blind bore of a sheath. The sheath is made of heat resistant metal such as stainless steel. The remaining space in the blind bore is then filled with a heat resistant electric insulating powder such as magnesia. In order to compress the heat resisting electrically insulating powder tightly around the filament for providing adequate support of the filament wire and for effecting adequate heat transfer to the metal sheath, the sheath is normally swaged inward to decrease its inside diameter and thereby compact the powder. One end of the filament at the bottom of the blind bore is connected to the metal sheath so that the metal sheath forms part of the electrical circuit.

Applicants found that a glow plug sheath formed from commercially feasible metallic materials is too vulnerable to oxidation and corrosion attack if it is continuously heated in the and exposed to an engine combustion chamber. The sheath is severely attacked by impurities, such as sodium, sulfur, phosphorus and/or vanadium, which enter the combustion chamber by way of fuel, lubrication oil, ocean spray and/or road salt. The metallic sheath is eaten away by these impurities so that the wire filament becomes exposed. The exposed wire filament is then subject to oxidation and corrosion attack and quickly fails.

Another type of conventional glow plug is generally shown in U.S. Pat. No. 4,502,430 issued to Yokoi et al. on Mar. 5, 1985. In this glow plug, the heating element assembly has a spirally-wound wire filament formed from tungsten or molybdenum which is bent in a generally U-shape. The wire filament is embedded in a ceramic insulator formed from silicon nitride ($Si_3N_4$). This design is advantageous for the construction of a ceramic glow plug not only because this ceramic material is an electrical insulator but also because this material can be hot pressed to effect good heat transfer from the filament to the ceramic material. In addition, silicon nitride possesses appropriate physical properties such as high strength, low coefficient of thermal expansion, high Weibull modulus and high toughness to permit the glow plug tip to survive the severe thermal and mechanical loadings imposed by the engine cylinder.

This glow plug design exhibits satisfactory life when the heating element assembly is electrically energized only during engine startup to effect ignition of the fuel in a conventional diesel engine. However, Applicants have found that this heating element assembly exhibits an unacceptably short life, for example about 250 hours, when operated continuously to effect ignition of methanol fuel in diesel-cycle engines operating in highway trucks. Similar to the metallic sheaths discussed above, the hot surface of the silicon nitride heating element assembly is vulnerable to severe oxidation and corrosion attack from impurities such as sodium, vanadium, phosphorus and/or sulfur. The silicon nitride covering is eaten away by these impurities so that the wire filament becomes exposed. The exposed wire filament is then subject to oxidation and corrosion attack and quickly fails.

Another type of known glow plug is disclosed in U.S. Pat. No. 4,786,781 issued to Nozaki et al. on Nov. 22, 1988. In this arrangement, a heating element has a generally U-shaped tungsten filament embedded in a silicon nitride insulator similar to that shown in Yokai et al.. However, the silicon nitride insulator is then covered, using a process called chemical vapor deposition, with a coating of highly heat and corrosion resistant material, such as alumina ($Al_2O_3$), silicon carbide (SiC) or silicon nitride ($Si_3N_4$) in an attempt to minimize erosion and corrosion due to combustion gases.

While this reference avers that the coating adequately protects the filament and silicon nitride covering shown in this glow plug against oxidation and corrosion attack, it has been Applicants' experience that ceramic coatings typically exhibit durability problems when they are applied to a glow plug heating element assembly which is continuously energized at a high temperature. If the coating is applied as a relatively thin layer, the coating quickly disappears from the heating element assembly due to the effects of corrosion and erosion. On the other hand, if the coating is applied as a relatively thick layer, the coating quickly flakes off the heating element assembly. Applicants believe such failure is caused primarily by unacceptably high thermal stresses, that are induced in the thick coating, as well as insufficient bonding of the coating to the insulator.

The present invention is directed to overcoming one or more of the problems as set forth above.

DISCLOSURE OF THE INVENTION

In one aspect of the present invention an improved heating element assembly is disclosed which is adapted for a glow plug. The heating element assembly includes a monolithic sheath, a heating means for emitting heat, and a heat transfer means for transferring heat from the heating means to the sheath. The sheath includes a relatively-thin and generally annular wall having a closed end portion and defines a blind bore. The heating means is positioned in the blind bore of the sheath and is adapted to be connected to a source of energy.

The improved heating element assembly may be used to effect ignition of fuel burned in various types of combustors. For example, the improved heating element assembly is particularly advantageous for use in diesel-cycle engines which (i) normally operate on low cetane fuels; or (ii) have a relatively low compression ratio; or (iii) which operate for substantial periods of time under cold conditions or conditions which result in marginal autoignition. In each of the above examples, autoignition of fuel is marginal. In order to achieve efficient engine performance, the subject heating element assembly is provided to assist fuel ignition and is capable of being energized either continuously or for extended periods. The subject heating element assembly may also be used in other combustion applications, such as industrial furnaces, where a relatively durable surface-ignition heating element is required for initiating or assisting the ignition and combustion of fuels.

BEST MODE FOR CARRYING OUT THE INVENTION

Figure 1:
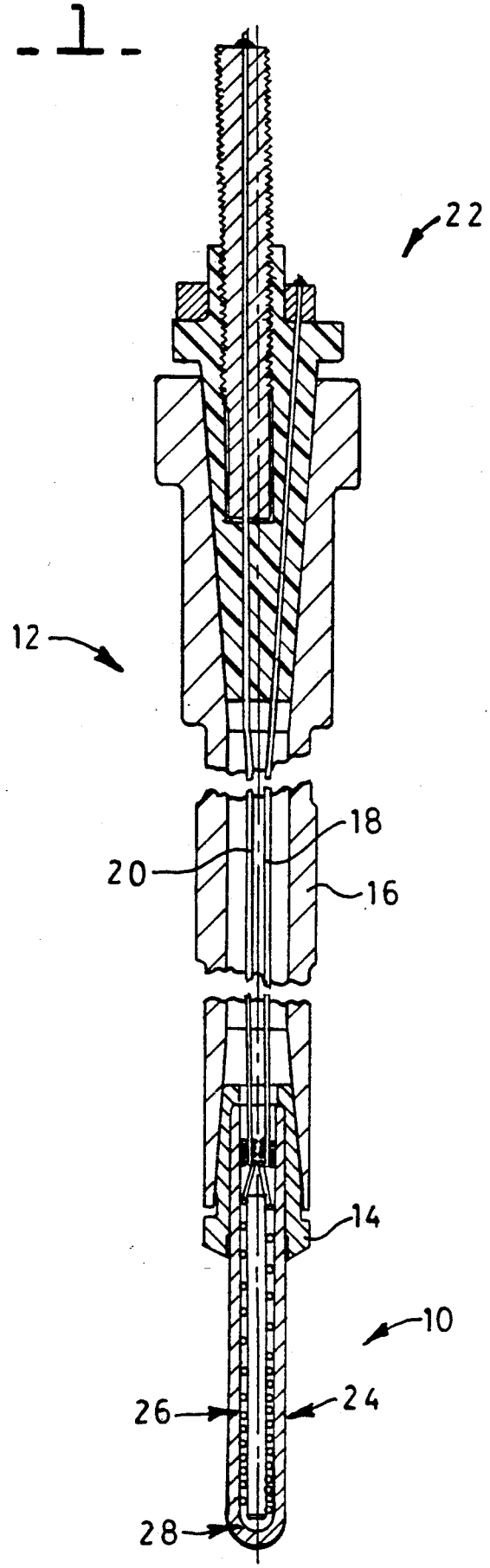
FIG. 1 is a diagrammatic cross-sectional view of a first exemplary embodiment of the present invention.

In FIGS. 1–6, similar reference characters designate similar elements or features throughout the figures. While there are many other uses for reliable, very high temperature heating element assemblies of the present invention, the principal use driving the technological development of this invention has been to effect or assist ignition of fuel on a continuous basis during all or a substantial portion of the normal operation of a diesel-cycle engine. For illustrative purposes, the specification will focus on this use.

Figure 2:
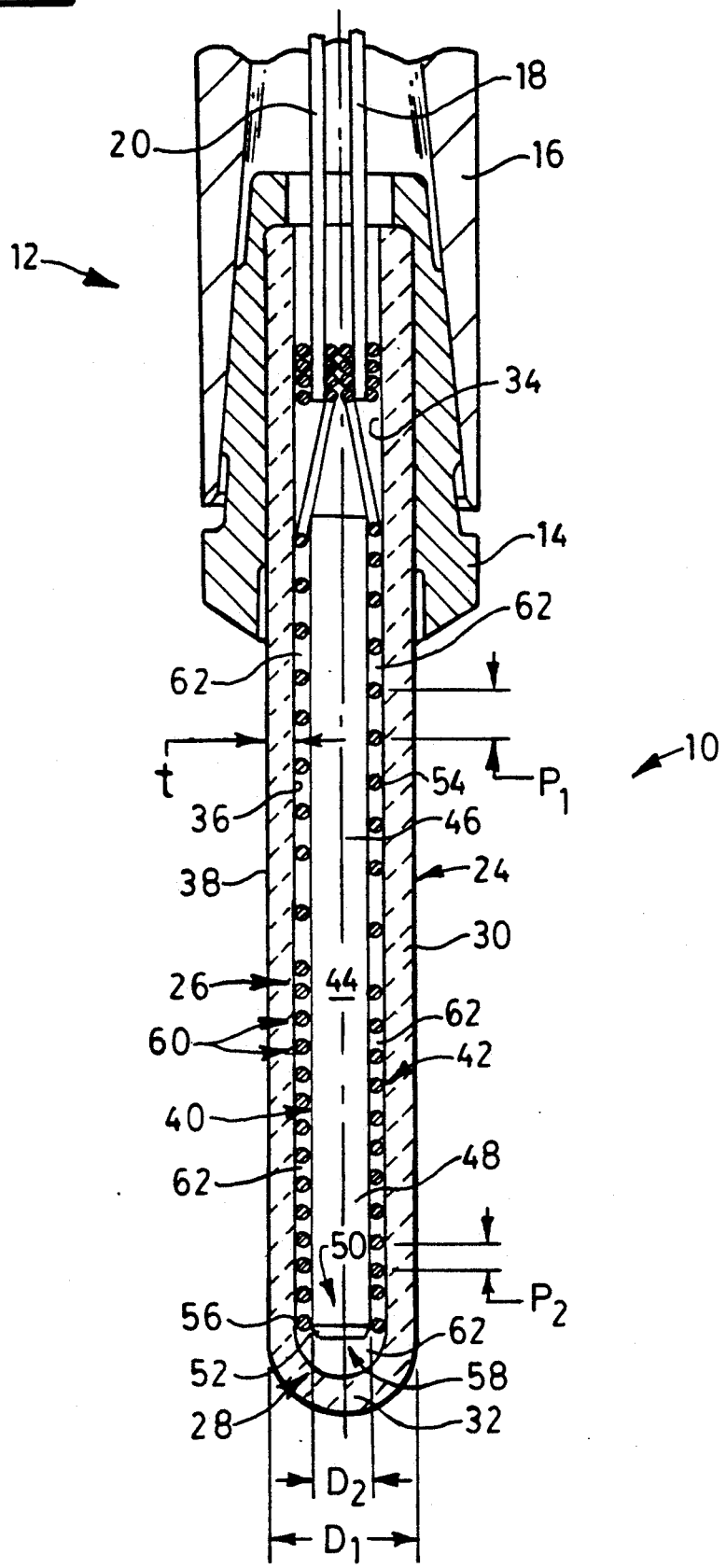
FIG. 2 is a diagrammatic enlarged partial view of FIG. 1.

In FIGS. 1 and 2, a first exemplary embodiment of an improved heating element assembly 10 is shown adapted for connection to an electrically-energizable glow plug 12. The glow plug 12 preferably includes a ferrule 14, a rigid body 16, a pair of spaced apart and relatively-low-resistance first and second electrical lead wires 18,20, and an electrical terminal means or device 22. The lead wires 18,20 are connected to the terminal means 22 which is adapted to be connected to an electrical source of energy (not shown). The heating element assembly 10 is preferably sealingly connected to the body 16 by a compression fit with the ferrule 14 as disclosed in Assignee's copending U.S. patent application Ser. No. 07/386,064 filed on July 28, 1989. Alternatively, the heating element assembly 10 may be sealingly connected to the body 16 by brazing or another conventional fastening technique. The subject invention specifically relates to the heating element assembly per se, and the discussion which follows will focus on various exemplary embodiments and methods of manufacturing it.

As shown in FIGS. 1 and 2, the heating element assembly 10 includes a refractory, corrosion-resistant, substantially-gas-impermeable, ceramic sheath 24, a heating means or device 26 for emitting heat within the sheath 24, and a heat transfer means or device 28 for transferring heat from the heating means 26 to the sheath 24.

As shown in FIG. 2, the sheath 24 per se is hollow and includes a relatively-thin and generally annular wall 30. The annular wall 30 has a closed end portion 32 and thereby defines a blind bore or cavity 34 of the sheath 24. The annular wall 30 includes an inner peripheral surface 36 and an outer peripheral surface 38 which are both substantially imperforate to the flow of gaseous fluids. Preferably, the inner and outer peripheral surfaces 36,38 are cylindrically-shaped, substantially smooth, and gradually rounded or radiused at the closed end portion 32 so that they are substantially free of stress concentrators. The annular wall 30 has a thickness t extending transversely between the inner and outer peripheral surfaces 36,38 which, preferably, is generally uniform along the axial length of the sheath 24.

The sheath 24 is a monolithic (i.e., single) piece formed of a carefully selected material. Suitable materials for the sheath 24 are selected in accordance with a new design methodology that is not taught by the prior art of glow plugs.

A primary function of the sheath 24 is to protect the heating means 26 from attack by corrosive gases present in the engine combustion chamber. In order to help accomplish this function, the sheath 24 must be able to resist attack by such corrosive gases while the sheath 24 is continuously heated at a preselected very high temperature (for example, about 1200° C./2192° F.) Applicants recognized a need for much more durable glow plugs after Applicants tried to use conventional glow plugs to assist ignition of relatively low cetane fuels in diesel-cycle engines. When attempting to use silicon nitride glow plugs of the type shown in the Yokoi patent, it was found that the silicon portion oxidized and the resultant silicon dioxide reacted with the impurities present in the combustion chamber to form compounds which have a much lower melting point. For example, the silicon dioxide reacts with sodium impurities to form sodium silicate. Sodium silicate formed bubbles which then melted or broke off. This process eats away the silicon nitride and exposes the heating filament to oxidation and/or other forms of corrosion which eventually create a broken electrical circuit.

Applicants found from published literature relating to gas turbine components that a similar corrosive process had been identified where the components were made from silicon nitride and were required to operate at high temperatures for long periods of time. The published literature also disclosed a corrosion test in which silicon nitride specimens were immersed in molten sodium sulfate.

Applicants subjected pieces of a conventional silicon nitride glow plug heating element assembly to this corrosion test and observed that the nature of the corrosion was similar to that experienced by such glow plugs actually operating in an engine combustion chamber. Applicants are convinced that the corrosion process which attacks conventional ceramic glow plugs in an internal combustion engine is caused by sodium and other impurities which are present in the engine combustion chamber during operation.

Applicants used the following corrosion test to evaluate various candidate ceramic materials. Ceramic samples were weighed and then submerged in molten sodium sulfate ($Na_2SO_4$) at about 1200° C./2192° F. for up to 100 hours. A platinum crucible was used to contain the materials. A twenty to one ratio (by weight) of sodium sulfate to ceramic material was used. Afterwards, the sodium sulfate was dissolved. The dried ceramic material was then weighed, and the weight loss was calculated. The results of corrosion tests on various materials are shown in the following table:

| CERAMIC MATERIAL | TIME (HOURS) | % WEIGHT LOSS |
|---|---|---|
| Silicon Nitride [$Si_3N_4$] | <25 | 100 |
| Sialon [SiAlON] | <25 | 100 |
| Aluminum Oxide [$Al_2O_3$] | 100 | nil |
| Aluminum Oxide with Silicon Carbide whiskers [$SiC_w$—$Al_2O_3$] | 100 | nil |
| Mullite [$3Al_2O_32SiO_2$] | 100 | nil |
| Cordierite [magnesium aluminosilicate] | 25 | nil |
| Aluminum Titanate [$Al_2TiO_5$] | 25 | nil |
| Beryllium Oxide [BeO] | 100 | nil |

The above results show that ceramics of the oxide family are hardly affected by the corrosion test while ceramics of the nitride and oxynitride families are severely attacked. Applicants believe that there are potentially many other oxide ceramics, not listed above, which would also pass the corrosion test.

A suitable sheath material must also have substantially no gas permeability. This property is important to help ensure that the sheath 24 effectively seals the heating means 26 from contact with the corrosive gases present in an operating engine combustion chamber. Preferably, the permeability of the sheath 24 is on the order of the atomic diffusion coefficient (for example, a gas permeability coefficient of about 0.0000001 darceys).

Finally, the candidate material must possess properties that will ensure that it does not fail due to thermal and/or mechanical stresses. Heat must flow outwardly through the annular wall 30 of the sheath 24 at a rate which both compensates for the heat lost from the heating element assembly 10 (via conduction to the glow plug body 16, radiation and convection) and elevates the temperature of the outer peripheral surface to the preselected very high temperature (for example, about 1200° C./2192° F.)

Heat flux is generally defined as the rate of transfer of heat energy through a given area of surface. The heat flux through the annular wall 30 of the sheath 24 causes the temperature of the inner peripheral surface 36 to exceed in temperature that of the outer peripheral surface 38. The effect of this difference in temperature between the two surfaces coupled with the coefficient of thermal expansion and Young's modulus or stiffness creates a tensile stress in the outer peripheral surface 38 of the heating element assembly 10.

Applicants have concluded that, under operating conditions, the maximum permissible average thermal stress in the sheath 24 should not exceed some preselected amount of the modulus of rupture (also known as the four-point bend strength) of the sheath material. The following equation was developed to predict resistance to failure caused by thermal stress:

$$\sigma = \frac{(\alpha)(E)(t)(Q/A)}{k} = (f)(MOR)$$

where $\sigma$ = maximum average thermal stress (MPa)

$\alpha$ = coefficient of thermal expansion (mm/mm° C.) of sheath 24

E = modulus of elasticity (MPa) of sheath 24 t = thickness (mm) of annular wall 30 of sheath 24 in the direction of heat flux Q/A = heat flux (W/mm$^2$) through the annular wall 30 of sheath 24 k = thermal conductivity (W/mm° C.) of sheath 24 f = preselected factor

MOR = modulus of rupture or four-point bending strength (MPa) of sheath 24.

A two-dimensional finite element model computer program was used to identify the temperature gradients in the sheath 24 and to determine the thermal stresses which those temperature gradients create. Such modeling showed that the thickness (t) of the annular wall 30 should be made as thin as practical in order to reduce the thermal stress to a satisfactorily low level. Thus, the above equation is rearranged by solving for t:

$$t = \frac{(f)\,(MOR)\,(k)}{(\alpha)\,(E)\,(Q/A)}$$

In order to solve the equation for a given material, quantitative values for the preselected factor (f) and heat flux are selected and inserted into the equation. The factor f effectively represents a margin of safety against failure caused by thermal stresses. The value for f may be selected from numbers greater than zero and equal to or less than one. For example, a value of f equals one would result in no margin of safety. To provide an adequate margin of safety under steady-state operating conditions, f may be selected to be about 0.5. However, due to the existence of transient conditions, it is preferable to select a more conservative value for f which is less than about 0.5 (for example, f equals about 0.25).

Several examples now follow where f is chosen to be 0.25 and Q/A is chosen to be 0.371 W/mm$^2$. It should be noted that, ideally, data on material properties should be obtained at the operating condition of interest. Thus, to the extent such data is available, the material properties for the sheath in each example are given at the exemplary operating temperature of about 1200° C./2192° F. On the other hand, some of the examples involve material properties for which data is not available at the exemplary operating temperature. The data and results in these examples should be carefully considered to determine if it would be valid to extrapolate results for the exemplary operating temperature.

| | |
|---|---|
| Example No. 1 | |
| material | silicon nitride [$Si_3N_4$] (Kyocera SN 220M) |
| E | 270,400 MPa @ 1200° C. |
| $\alpha$ | 0.0000036 mm/mm °C. @ 1200° C. |
| k | 0.0153 W/mm °C. @ 1200° C. |
| MOR | 400 MPa @ 1200° C. |
| t | 4.24 mm |
| Example No. 2 | |
| material | sialon [SiAlON] |
| E | 300,000 MPa @ 20° C. |
| $\alpha$ | 0.00000304 mm/mm °C. @ 1000° C. |
| k | 0.0213 W/mm °C. @ 20° C. |
| MOR | 400 MPa @ 1200° C. |
| t | 6.30 mm |
| Example No. 3 | |
| material | aluminum oxide [$Al_2O_3$] |
| E | 268,000 MPa @ 1200° C. |
| $\alpha$ | 0.0000085 mm/mm °C. @ 1200° C. |
| k | 0.006 W/mm °C. @ 1200° C. |
| MOR | 20 MPa @ 1200° C. |
| t | 0.035 mm |
| Example No. 4 | |
| material | aluminum oxide with 10% silicon carbide whiskers [$SiC_w$—$Al_2O_3$] |
| E | 170,000 MPa @ 1200° C. |
| $\alpha$ | 0.000007 mm/mm °C. @ 1200° C. |
| k | 0.0065 W/mm °C. @ 1200° C. |
| MOR | 178 MPa @ 1200° C. |
| t | 0.65 mm |
| Example No. 5 | |
| material | sintered mullite [$3Al_2O_32SiO_2$] |
| E | 100,000 MPa @ 1200° C. |
| $\alpha$ | 0.000005 mm/mm °C. @ 1200° C. |
| k | 0.004 W/mm °C. @ 1200° C. |
| MOR | 150 MPa @ 1200° C. |
| t | 0.81 mm |
| Example No. 6 | |
| material | cordierite [magnesium aluminosilicate] |
| E | 61,000 MPa @ 20° C. |
| $\alpha$ | 0.0000028 mm/mm °C. @ 1200° C. |
| k | 0.0007 W/mm °C. @ 20° C. |
| MOR | 55 MPa @ 20° C. |
| t | 0.15 mm |
| Example No. 7 | |
| material | aluminum titanate [$Al_2TiO_5$] |
| E | 20,000 MPa @ 1000° C. |
| $\alpha$ | 0.00000153 mm/mm °C. @ 1200° C. |
| k | 0.00209 W/mm °C. @ 1200° C. |
| MOR | 120 MPa @ 1200° C. |
| t | 0.55 mm |
| Example No. 8 | |
| material | beryllium oxide [BeO] |
| E | 344,740 MPa @ 20° C. |
| $\alpha$ | 0.00001017 mm/mm °C. @ 1200° C. |
| k | 0.0178 W/mm °C. @ 1200° C. |
| MOR | 207 MPa @ 20° C. |
| t | 0.71 mm |

It is emphasized that ceramic materials are brittle and, consequently, the stress at any part of the sheath cannot exceed the material strength at that location. In other words, the materials are not forgiving and will not yield as would a metal to reduce the local stress. Instead, the sheath will simply fail by fracturing. It is also noted that the strength actually varies throughout the ceramic sheath. Consequently, the design of a ceramic sheath 24 requires the use of statistical data such as Weibull modulus and the reliability and durability are expressed as a probability of failure. While the last equation above provides the designer with a tool by which the designer can evaluate other candidate materials which have been found to pass Applicants' recommended corrosion test and gas impermeability criteria, accurate design will require the use of advanced analysis tools such as finite element analysis to gain high confidence in the temperatures and probability of failure of the heating element assembly. The above equation may also be used to evaluate non-ceramic materials for the sheath 24.

The last equation above can be used to weigh the trade-offs between the various material properties. For example, plain aluminum oxide ($Al_2O_3$) was the first ceramic material considered for the sheath material because it exhibits excellent corrosion resistance. However, Applicants found that a prototype ceramic sheath formed of this material cracked after only a few hours of operation in an engine test. Example No. 3 above also indicates that plain aluminum oxide is an unsuitable material with respect to its ability to survive thermal stresses. When the material property values of plain aluminum oxide are substituted into the last equation above, they produce a maximum allowable thickness t for the sheath annular wall 30 which is too thin to manufacture as well as too thin to withstand mechanical loadings that a glow plug would typically experience in an engine combustion chamber.

Example No. 4 illustrates how the addition of silicon fiber whiskers improves the thermal stress properties of aluminum oxide. This relatively new composite ceramic, called silicon-carbide-whisker-reinforced alumina ($SiC_w$-$Al_2O_3$), was developed by Arco Chemical Company and used primarily for machine tool bits. The addition of the whiskers changes the material properties of that ceramic in a way that substantially improves its thermal shock resistance. The calculated maximum permissible thickness t also indicates that if this material is formed as a solid piece, similar to the silicon nitride insulator which embeds the heating filament shown in the Yokoi patent, it would not possess sufficient thermal and mechanical properties to survive in an engine combustion chamber.

At the present time, silicon-carbide-whisker-reinforced aluminum oxide is Applicants' preferred material for the sheath 24 and it has been proven successful in bench and engine tests. For example, Applicants have successfully made and tested a sheath 24 made of this material which has an annular wall thickness t of about 0.5 millimeters/0.02 inches. This annular wall thickness was conservatively chosen to be below the upper limit of 0.65 millimeters/0.03 inches given in Example No. 4 in order to enhance the factor of safety against failure by thermal stresses. On the other hand, this annular wall thickness is sufficient to be practical for manufacturing the sheath 24 as a monolithic piece. This annular wall thickness is also sufficient to provide enough strength for assembling the sheath 24 to the glow plug body and also for surviving the mechanical loading the sheath 24 would experience in an engine combustion chamber. The composite material for the sheath 24 contained about 5 to 40 percent by volume of silicon carbide whiskers and about 95 to 60 percent by volume of aluminum oxide. The silicon carbide whiskers were single crystals having a length of about 5 to 200 microns long and a diameter of about 0.1 to 3 microns.

Example No. 7 suggests that aluminum titanate ($Al_2TiO_5$) might be a promising material from the standpoint of surviving thermal stresses.

A monolithic sheath 24 can be formed by pressing, slip-casting, injection-molding, or extruding a mixture of the silicon carbide whiskers, aluminum oxide powder, water, and organic binders. In order to make the sheath 24 substantially imperforate, the sheath 24 is then densified (typically to greater than 95% of theoretical density) by sintering, hot-pressing, or hot-isostatic-pressing. If necessary, the final outside diameter of the outer peripheral surface 38 as well as its substantially-smooth profile, inside diameter of the blind bore 34 as well as its substantially smooth profile, the rounded profile of closed end portion 32, and chamfer at the opposite open end portion of the blind bore 34 are formed such as by a machining operation.

Other ceramic oxide materials may also give an acceptable low probability of failure. Mullite is not as strong as aluminum oxide, but it has a lower coefficient of thermal expansion and modulus of elasticity which effectively give a lower calculated thermal stress for a given thickness t of the sheath annular wall 30. Also, silicon carbide whiskers can be added to the mullite matrix to increase the strength of the composite. Beryllium oxide is another material which has a relatively-low strength, but it has a relatively high thermal conductivity and modulus of rupture which collectively make it a promising material. Hafnium titanate and cordierite are materials whose respective low strengths can be offset by their respective extremely low coefficients of thermal expansions. Silicon nitride, sialon, and silicon carbide have material properties which give low calculated stresses, but these materials have low resistance to corrosion which eliminates them as suitable materials for the sheath 24.

Many other ceramic materials (mostly ceramic oxide materials) may be suitable candidates as the material forming the sheath 24. Such suitable materials include plain aluminum oxide, titanium oxide, yttrium oxide, sodium zirconium phosphate, and chromium oxide densified aluminum oxide. The process of making chromium oxide densified aluminum oxide is disclosed in U.S. Pat. No. 3,956,531 issued to Church et al. on May 11, 1976. If necessary, these materials may be reinforced with ceramic material in the form of particulates or whiskers selected from the group of oxides, carbides, nitrides, and borides such as zirconium oxide, silicon carbide, silicon nitride, and titanium boride.

The function of the heating means 26 is to provide the energy required to maintain the temperature of the outer peripheral surface 38 of the sheath 24 at the preselected very high temperature (for example, about 1200° C./2192° C.) This energy must be provided at a rate that compensates for the loss of energy from the sheath 24 caused by convection, radiation and conduction to the glow plug body 16. The heating means 26 should be selected so that the heating means 26 does not impart appreciable stress to the sheath 24 during thermal expansion and/or contraction. However, since the heating means 26 is covered by the protective sheath 24, suitable materials for the heating means 26 do not need to be corrosion resistant.

FIGS. 1 and 2 show a first exemplary embodiment of the heating element assembly 10 wherein the heating means 26 includes a mandrel 40 and a heating filament 42.

The mandrel 40 is formed from a rigid electrically non-conductive material. Thermal growth and contraction of the mandrel 40 must be compatible with thermal growth and contraction of the sheath 24. As a general rule of thumb, the product of the diameter $D_2$, coefficient of thermal expansion, and difference between operating and ambient temperatures for the mandrel 40 should be smaller than the product of the diameter $D_1$, coefficient of thermal expansion, and difference between operating and ambient temperatures for the sheath 24. Such thermal compatibility between the sheath 24 and the mandrel 40 ensures that the mandrel 40 does not induce mechanical stresses into the sheath 24 by outgrowing the confines of the sheath 24 during thermal expansion and contraction. Preferably, the mandrel 40 is formed from any of several ceramic materials selected from the group of oxides, nitrides, or carbides but, as previously mentioned, depends upon the desired thermal expansion and thermal conductivity needed for compatibility with the rest of the heating element assembly 10. For example, the mandrel 40 may be formed from mullite ($3Al_2O_32SiO_2$) when the sheath 24 is formed from an aluminum oxide based ceramic material such as silicon carbide whisker reinforced alumina ($SiC_w$-$Al_2O_3$).

The mandrel 40 is positioned in the blind bore 34 in symmetrically spaced relation to the inner peripheral surface 36 of the sheath 24. The mandrel 40 includes a smooth outer peripheral surface 44 having first and second end portions 46,48. In the embodiment of FIGS. 1 and 2, the mandrel 40 preferably has an elongated solid cylindrical shape and the second end portion 48 has an end 50 which defines a diametrical groove or notch 52. Alternatively, the outer peripheral surface 44 may have relatively shallow helical grooves formed thereon to receive and locate the heating filament 42.

In FIGS. 1 and 2, the heating filament 42 is positioned in the blind bore 34 in spaced relation to the inner peripheral surface 36 of the sheath 24. Preferably, the heating filament 42 is formed from a continuous single strand of wire formed from a refractory resistance-heating material such as molybdenum, nichrome, alumel, chromel, platinum, tungsten or similar noble metal, tantalum, rhodium, molybdenum disilicide, rhenium, or platinum-rhodium alloys.

The heating filament 42 has first and second end portions 54,56 and an intermediate portion 58 located therebetween. The intermediate portion 58 of the heating filament 42 is positioned immediately adjacent the end 50 of the second end portion 48 of the mandrel 40. In the embodiment of FIGS. 1 and 2, the intermediate portion 58 of the heating filament 42 is positioned in the diametrical groove 52 of the mandrel 40.

The first end portion 54 of the heating filament 42 is helically wound around and in tight contact with the first end portion 46 of the outer peripheral surface 44 of the mandrel 40 according to a reoccurring first preselected pitch $P_1$. The first end portion 54 of the heating filament 42 is helically wound around and in tight contact with the second end portion 48 of the outer peripheral surface 44 of the mandrel 40 according to a reoccurring second preselected pitch $P_2$ which is smaller than the first pitch $P_1$. For example, the first or relatively coarse pitch $P_1$ may preferably be about 4.72 windings per centimeter (about 12 windings per inch) and the second pitch $P_2$ is about 12.6 windings per centimeter (about 32 windings per inch).

The second end portion 56 of the heating filament 42 extends between the second and first end portions 48,46 of the mandrel 40 in radially as well as axially spaced relation to the inner peripheral surface 36 of the sheath 24. It should be kept in mind that in the alternative embodiments of FIGS. 2 and 3, the first and second end portions 54,56 of the heating filament 42 are connected (and intersect one another) only at the intermediate portion 58 of the heating filament 42.

In the embodiment of FIGS. 1 and 2, the second end portion 56 is helically wound around and in tight contact with the outer peripheral surface 44 of the mandrel 40. The windings of the second and first end portions 54,56 of the heating filament 42 are evenly spaced from one another in the axial direction and collectively form a double helix 60. In other words, the double helix 60 is helically wound around the second end portion 48 of the mandrel 40 according to an effective fine pitch which is about double the second preselected pitch $P_2$. Moreover, the double helix 60 is helically wound around the first end portion 46 of the mandrel 40 according to an effective coarse pitch which is about double the first preselected pitch $P_1$.

Thus, in the example given above, the effective coarse pitch of the first and second end portions 54,56 of the heating filament 42 is about 9.44 windings per centimeter (about 24 windings per inch). Moreover, the effective fine pitch of the first and second end portions 54,56 is about 25.2 windings per centimeter (about 64 windings per inch).

Alternatively, the heating means 26 may include other embodiments such as a refractory electrically-conductive heating material deposited on the inner peripheral surface 36 of the sheath 24 or the inner peripheral surface 36 itself selectively modified by chemical treatment at various locations to form an electrical path.

The heat transfer means 28 is interposed between the heating means 26 and the inner peripheral surface 36 of the sheath 24. The heat transfer means 28 performs two functions. One function is to support the heating means 26 within the blind bore 34 of the sheath 24. The other function is to provide a means for efficient heat transfer from the heating means 26 to the inner peripheral surface 36 of the sheath 24. Such heat transferred to the sheath 24 then passes through the annular wall 30 of the sheath 24 to maintain the outer peripheral surface 38 at the preselected very high temperature.

In FIGS. 1 and 2, the heat transfer means 28 includes filler material 62. The filler material 62 is disposed in the blind bore 34 of the sheath 24 and completely fills the remaining space between the mandrel 40, the heating filament 42, and the sheath 24. The filler material 62 is formed of a heat conductive material which is adapted to readily transfer the heat generated by the heating filament 42 to the outer peripheral surface 38 of the sheath 24 when the heating element assembly 10 is electrically energized. Preferably, the filler material 62 is a cement formed from calcium aluminate and distilled water. Other filler materials may be substituted including zirconium silicate cement, aluminum oxide powder, magnesium oxide powder, or any of the above materials with additions (about 5 to 40% by volume) of silicon carbide, platinum, or molybdenum particulate to make the filler material more thermally conductive.

Figure 3:
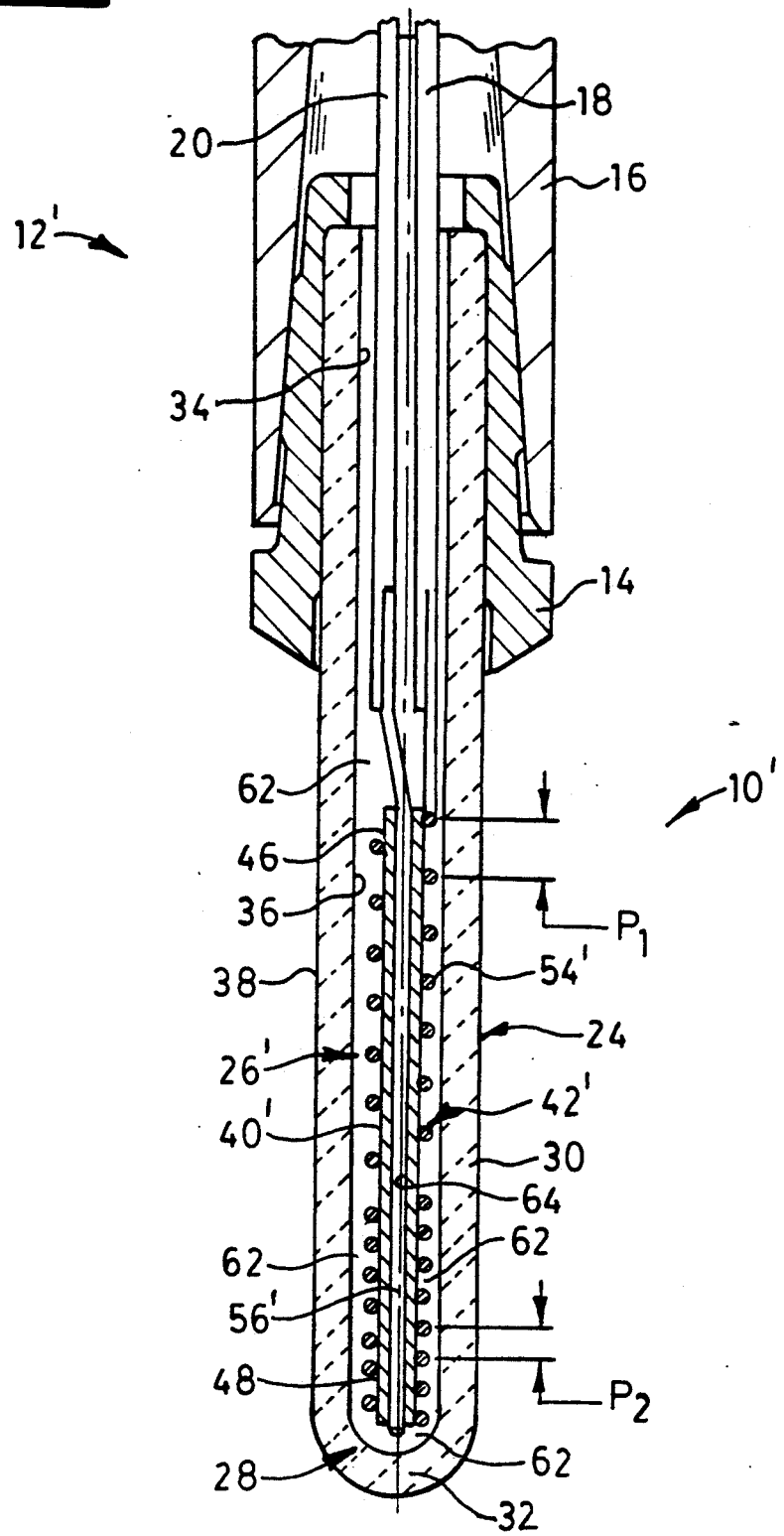
FIG. 3 is a diagrammatic view similar to FIG. 2 but showing a second exemplary embodiment of the present invention.

FIG. 3 shows a second exemplary embodiment of the heating element assembly 10'. The heating element assembly 10' is similar to the heating element assembly 10 of FIGS. 1 and 2 except for the shape of the mandrel 40' and the location and arrangement of the second end portion 56' of the heating filament 42'.

In FIG. 3, the mandrel 40' has a longitudinal through bore 64 and the second end portion 56' of the heating filament 42' extends generally straight through the mandrel bore 64 between the second and first end portions 48, 46 of the electrically insulating mandrel 40'. The first end portion 54' of the heating filament 42' is helically wound around and in tight contact with the first end portion 46 of the outer peripheral surface 44 of the mandrel 40' according to a reoccurring first preselected pitch $P_1$. The first end portion 54' of the heating filament 42' is helically wound around and in tight contact with the second end portion 48 of the outer peripheral surface 44 of the mandrel 40' according to a reoccurring second preselected pitch $P_2$ which is smaller than the first pitch $P_1$. For example, the first or relatively coarse pitch $P_1$ is preferably about 4.72 windings per centimeter (about 12 windings per inch) and the second pitch $P_2$is about 12.6 windings per centimeter (about 32 windings per inch).

Alternatively, the heating filament 42' may be formed of two wires of different cross-sectional diameters. The larger diameter wire would be positioned in and extend through the mandrel bore 64. The smaller diameter wire would be helically wound around and in tight contact with the outer peripheral surface 44 of the mandrel 40'. The two wires would be connected together adjacent to the second end portion 48 of the mandrel 40'. This design is advantageous because the larger diameter portion of the heating filament 42'extending through the mandrel 40' would not generate significant heat. Thus, there is no significant heat which could become trapped (and cause melting of that portion of the heating filament 42') if there is too much clearance in the mandrel bore 64 between the mandrel 40' and the heating filament 42'.

Figure 4:
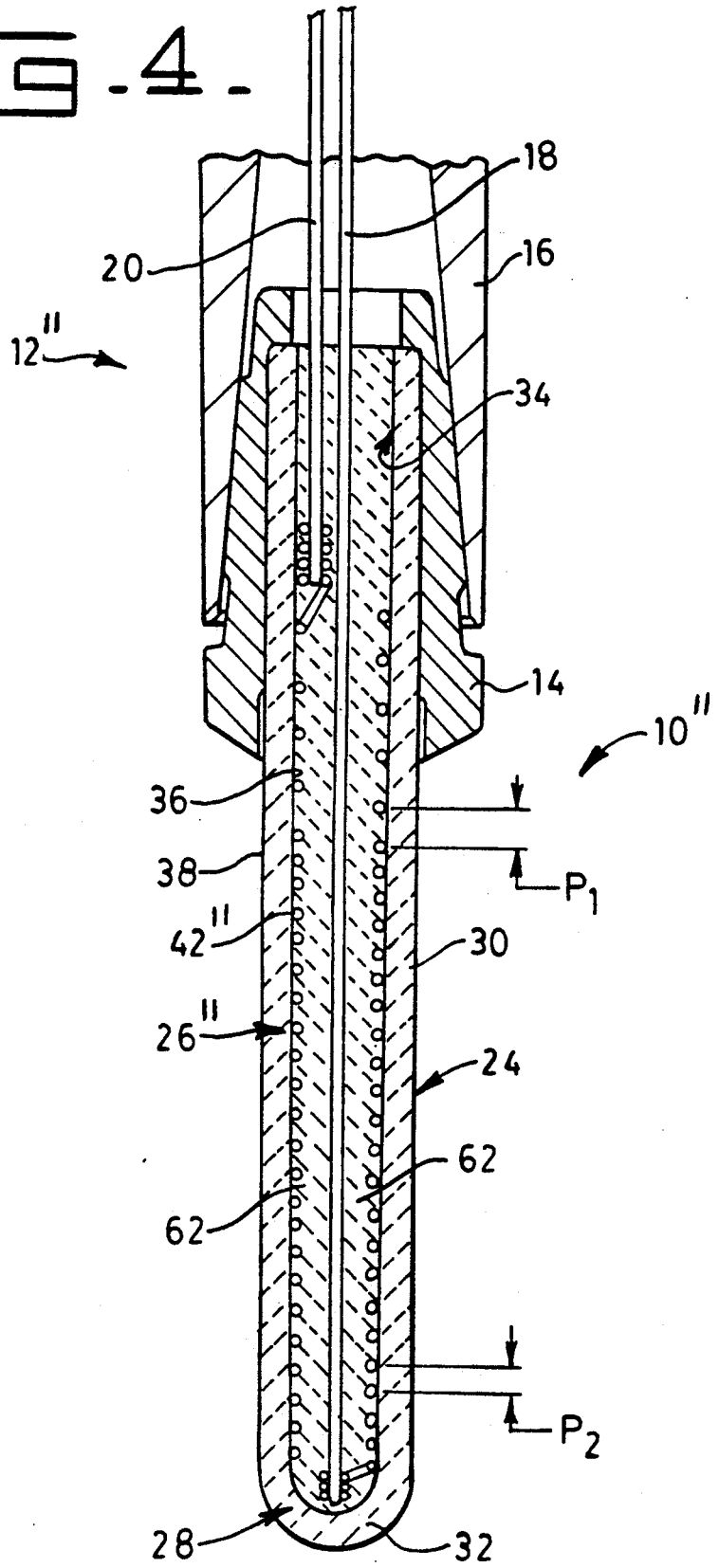
FIG. 4 is a diagrammatic view similar to FIG. 2 but showing a third exemplary embodiment of the present invention.

FIG. 4 shows a third exemplary embodiment of the heating element assembly 10''. The heating element assembly 10'' 4 is similar to the heating element assembly 10' of FIG. 3 except that there is no mandrel. Moreover, the first electrical lead wire 18 centrally extends into the blind bore 34 adjacent to the closed end portion 32 where it is connected to an end portion of the heating filament 42''. The second electrical lead wire 20 peripherally extends into the blind bore 34 where it is connected to the other end portion of the heating filament 42''. The heating filament 42'' is a single helix which directly contacts the inner peripheral surface 36 of the sheath 24. Alternatively, the embodiment of FIG. 4 may be modified so that the heating filament 42'' is a double helix which directly contacts the inner peripheral surface 36 of the sheath 24 similar to FIG. 2 but without a mandrel.

In any of the above embodiments where the sheath 24 directly contacts the heating filament 42, the material for the sheath is also chosen to be electrically non-conductive. Moreover, in any of the above embodiments where the filler material 62 directly contacts the heating filament 42, the material for the filler material 62 is also chosen to be electrically non-conductive.

INDUSTRIAL APPLICABILITY

A brief description of various methods of manufacturing the improved heating element assembly 10, 10', 10'' and its operation will now be discussed.

In the first exemplary embodiment of FIGS. 1 and 2, the mandrel 40 per se is temporarily affixed to a helically threaded rod of a rotatable fixture (not shown) which is used to subassemble the heating filament 42 to the mandrel 40. The rod has at least two separate and different helical thread pitches which, as the rod and mandrel are advanced together by rotation, controlledly determine the axial spacing between adjacent windings of the heating filament 42. A relatively modest coating of cement (such as Duco cement made by Devcon Corporation, Wood Dale, Ill. 60191, U.S.A.) is preferably applied over the outer peripheral surface 44 of the mandrel 40 but not on the end 50. The cement should have a drying time which does not expire before the heating filament 42 is completely wound around the mandrel 40.

The intermediate portion 58 of the heating filament 42 is positioned in the diametrical groove 52 of the affixed mandrel 40. In the embodiment of FIGS. 1 and 2, the first and second end portions 54,56 of the heating filament 42 are evenly wound around the mandrel 40 in the shape of a double helix 60. In the embodiment of FIG. 3, the second end portion 56, of the heating filament 42' is positioned in the bore 64 of the mandrel 40, and only the first end portion 54 of the heating filament 42 is helically wound around the mandrel 40.

Winding the heating filament 42 tightly around the rigid mandrel 40,40' is advantageous because the heating filament is symmetrically disposed in a circumferential direction and because it produces a controlled and repeatable configuration of filament windings which can be closely and evenly spaced without creating an electrical short.

Moreover, the axial spacing between adjacent windings may be further tightly controlled by simultaneously winding a temporary monofilament line, such as fishing line, between adjacent windings of the heating filament. Preferably, an intermediate portion of the monofilament line is positioned in a second groove (not shown) defined at the end 50 of the mandrel 40. The second groove is preferably oriented perpendicular to the groove 52.

After the heating filament windings (i.e., double or single helix) are completed on the mandrel 40,40', the temporary monofilament is removed from the subassembly 40,42. After the Duco cement has dried, the subassembly 40,42 is removed from the winding fixture.

The pair of lead wires 18,20 are attached to the respective first and second end portions 54,56 of the heating filament 42, preferably by using a hand winding device (not shown). Preferably, the lead wires 16,18 are formed of molybdenum clad with platinum, although other materials could be substituted such as tungsten, tantalum, or copper. Each end portion 54,56 of the relatively smaller diameter heating filament 42 is wrapped around a respective relatively larger lead wire 16,18 as tightly as possible. The end portions 54,56 of the heating filament 42 should be wrapped around only enough to provide an adequate electrical connection which, for example, is about 10 windings. The lead wires 18,20 are separated from one another, preferably by inserting them in a thin ceramic insulator (not shown) which resembles a pair of drinking straws arranged side by side. For example, the ceramic insulator may be formed from zirconia.

Unlike known heating elements which embed the heating filament in a sintered ceramic material, the monolithic configuration of the sheath 24 is advantageous because it is controlledly formed to its final shape separate from the heating filament 42 and therefore does not affect the final configuration and orientation of the heating filament 42. The relatively smooth and simple shape of the sheath 24 is virtually free of stress concentrators and is relatively easy to manufacture by, for example, slip-casting, hot pressing, injection molding, or selectively machining solid bar stock.

The filler material 62 is formed by creating a thin mixture of about 250-mesh calcium aluminate cement and distilled water. About two milliliters of distilled water per gram of calcium aluminate provides the preferred consistency for the wet cement that is created. This wet cement is poured into a syringe and excess air is purged therefrom. The injection tip of the syringe is inserted down at the bottom of the empty blind bore 34 of the sheath 24 and the wet calcium aluminate cement is injected until the blind bore 34 of the sheath 24 is filled.

The heating filament, mandrel and lead wires subassembly 42,40,16,18 is now inserted into the blind bore 34 of the sheath 24. The subassembly 42,40,16,18 is immediately pushed all the way down into the blind bore 34 before drying and solidifying of the calcium aluminate cement occurs. The assembly 24,42,40,16,18 is then x-rayed to ensure that the subassembly 24,42,40,16,18 extends adjacent to the bottom of the blind bore 34 and that there are no electrical shorts or breaks in the electrical circuit defined by the lead wires 18,20 and the heating filament 42. The assembly 24,42,40,16,18 or heating element assembly 10 is then cured overnight in a humid environment. This can be accomplished by placing the heating element assembly 10 in a humidity chamber. After curing, the heating element assembly is dried, for example, in an oven to remove moisture.

If Duco cement was previously applied to the mandrel 40 as described above, it should be burned off by electrically heating the heating element assembly 10. The lead wires 18,20 of the heating element assembly 10 are connected to an electrical power supply and the voltage across the lead wires 16,18 is gradually increased from 0 to 8 volts in 0.5 volt increments. At about 8 volts, the heating element's electrical resistance drops considerably and the heating element assembly 10 begins to glow at the top portion where the heating filament 42 begins. This should be allowed to continue only until this hot zone begins to glow a bright orange which is at about 6 amps of electrical current. The voltage is then reduced to about 4 volts and left there for about one minute. The voltage is then increased at a rate which maintains the current at about 4.5 amps. This burnout procedure needs to be done only until the voltage which produces a hot zone down to the tip is achieved. This procedure will vary slightly depending on the amount of Duco cement used. It is preferable, however, to increase this voltage by about 20% and maintain the heating element assembly in this state for about 20 minutes. The voltage is then reduced to zero and the power supply is shut off. The heating element assembly 10 is now ready to be assembled to the glow plug body 16 by, for example, using the ferrule 14 or by brazing. The magnitudes of the voltage and current given above are merely illustrative and depend on the diameter and length of the heating filament 42.

Alternatively, the mandrel 40,40' may be formed with shallow helical grooves in order to receive and position the coils of the heating filament 42.

A method of assembling the third exemplary embodiment of the heating element assembly 10'', shown in FIG. 4, will now be discussed. An elongated tool (not shown) is used to help assemble the heating element assembly 10''. The tool includes screw threads that are accurately formed on the outer peripheral surface of the tool and a cylindrical bore axially extending through the center. For example, Applicants have used a modified No. 5-40 screw as the tool where the inside diameter of the sheath 24 was selected to be about 4 millimeters/0.16 inches.

First, one end portion of the heating filament 42'' is connected (for example, by tightly winding around) to an end portion of the lead wire 20. A guide tube is then temporarily slipped over the lead wire 20 and the guide tube is removably clamped so it and the lead wire 20 will not move relative to the tool. The lead wire 18 is then is inserted into the central bore of the tool until the lead wire 18 extends out the other end of the tool bore. The heating filament 42'' is wrapped tightly around the helical threads of the tool and the free end of the heating filament 42'' is wrapped tightly around the free end of the lead wire 18. This subassembly of the tool, lead wires 18, 20, guide tube, and heating filament 42'' is then held stationary by a fixture. For purposes of description with reference to the drawings, it will be assumed that the subassembly is oriented generally as the lead wires 18,20 and heating filament 42'' are shown in FIG. 4 although one may certainly choose a different orientation to actually assemble the components.

In the fixture, the upper end portions of the lead wires 18,20 are held apart and each is temporarily fixed, such as by clamping, so that it cannot rotate or move axially. The lower end portion of the lead wire 18 is also temporarily fixed so that it cannot rotate or move axially. The tool is then removed from the helical heating filament 42'' by unscrewing the tool out of the coils. The device holding the upper end portion of the lead wire 18 is removed to allow complete removal of the tool from the subassembly. Then the upper end portion of the lead wire 18 is again temporarily fixed. After removal of the tool, the lead wire 20 and guide tube are moved laterally to rest against the lead wire 18 and the guide tube is temporarily fixed. The device fixing the lower end portion of the lead wire 18 is then removed and the sheath 24 is slipped over the heating filament 42'' until the heating filament 42'' bottoms out adjacent to the closed end portion of the blind bore 34. The device fixing the upper end portion of the lead wire 18 is then removed which allows the lead wire 18 and coiled heating filament 42'' to rotate until the coils of the heating filament 42'' radially expand against the inner peripheral surface of the sheath 24. If necessary, the lead wire 18 and heating filament connected thereto may be further rotated in order to ensure that the coils directly contact the inner peripheral surface 36 of the sheath 36. The lead wires 18,20 are then temporarily fixed again in spaced apart relation. The device fixing the guide tube is then removed and the guide tube is slipped up the lead wire 20 until it is clear outside of the blind bore 34. Then the filler material 62 is added (for example, using a syringe) to the blind bore 34 to completely fill any voids therein. The filler material 62 added to the blind bore 34 is allowed to cure and then the subassembly of the lead wires 18,20, heating filament 42Δ, sheath 24 and filler material 62 is removed from the fixture.

In order to make a heating element assembly wherein the heating filament 42,, is arranged as a double helix, a double-threaded screw would be substituted for the winding tool. Two short lengths of tubing would be employed to position the lead wires and a removable third member having a slot formed at one end would be used to engage the lower end portion of the heating filament. The third member would be rotated to tighten the coils so that their mean diameter is reduced prior to assembly with the sheath 24. The third member and guide tub®s Would then be removed prior to filling the blind bore 34 with filler material.

Figure 5:
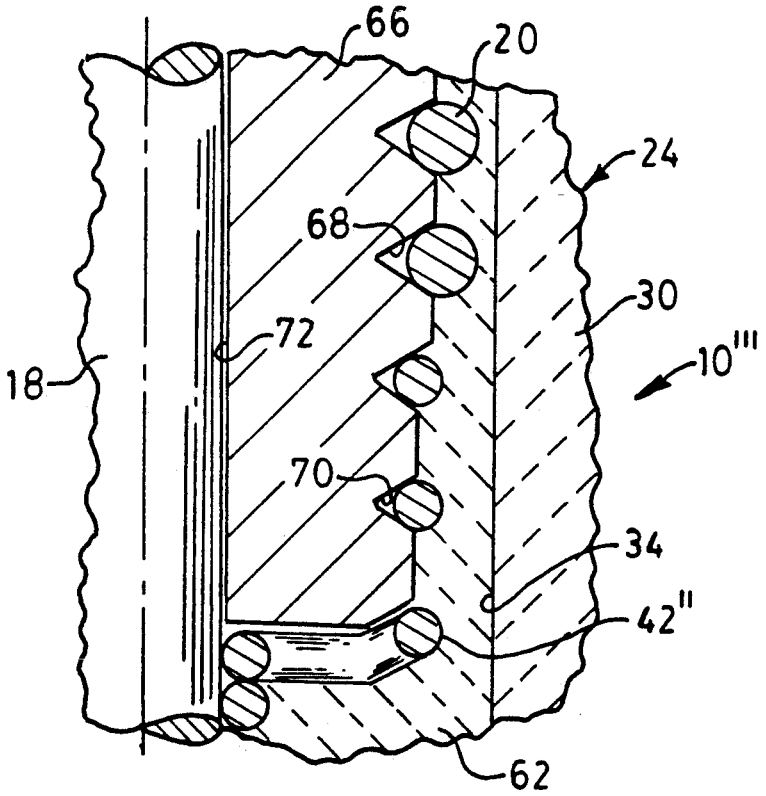
FIG. 5 is a diagrammatic enlarged partial view similar to FIG. 4 but showing a fourth exemplary embodiment of the present invention. This view is generally symmetrical about the longitudinal axis of lead wire 18.

An alternate method of achieving the same basic objectives is shown in FIG. 5 and involves winding the heating filament 42'' and relatively larger lead wire 20 connected (for example, by butt welding) to the heating filament 42'' on a polished and waxed modified-screw tool 66 somewhat smaller than the inside diameter of the sheath 24. The threads 68,70 of the tool 66 are turned or ground down to outside diameters which are very close to the diameter of the centerlines of the coils. The tool 66 is inserted into the sheath 24 and immersed with filler material 62 to fully embed the closely wound coils of the heating filament 42'' and the adjacent portion of the connected lead wire 20. The tool 66 has a center hole to accommodate the center lead wire 18. The filler material 62 is allowed to harden and then the screw tool 66 is carefully removed by unscrewing, leaving the closely wound coils of the heating filament 42'' and a portion of the lead wire 20 embedded in the filler material 62. The center lead wire 18 is then inserted into the blind bore 34 and aligned along the longitudinal axis of the sheath 24. Additional filler material 62 is then inserted into the blind bore 34 to completely fill remaining voids in the blind bore 34.

In order to make a heating element assembly wherein the heating filament 42'' and lead wire 20 are arranged as a double helix, a double-threaded screw would be substituted for the winding tool.

The first method of assembling the heating element assembly 10'' of FIG. 4 is preferred because the coils of the heating filament 42'' are positioned in direct contact with the sheath inner peripheral surface 36 which is expected to improve heat transfer from the heating means 26 to the sheath 24. The filler material is also easier to apply in this arrangement and it will be less subject to damage by subsequent steps of assembly.

The embodiment of FIG. 4 is believed to have the following advantages compared with the embodiments of FIGS. 1-2 or 3. First, the coils of the heating filament 42'' are in direct contact with the inner peripheral surface 36 of the sheath 24. This direct contact provides more efficient heat transfer compared with filler material 62 as an interface. During assembly before the filler material 62 is added, the coils of the spring-like heating filament 42'' expand against the inner peripheral surface 36 to more positively locate the position of the heating filament 42'' within the sheath blind bore 34. Moreover, the coils can conform to irregularities which might be present on the inner peripheral surface 36. Second, the filler material 62 is easier to apply because there is more open space and opportunity for venting due to the absence of a mandrel. Third, the mandrel is entirely eliminated thereby eliminating some amount of cost.

In operation of the glow plug 12 shown in FIG. 1, electrical current flows into the lead wire 18, through the heating filament 42, and out through the lead wire 20. The relatively smaller diameter of the heating filament 42 creates relatively more electrical resistance in the heating filament than elsewhere in the electrical circuit and therefore generates heat. This heat is readily communicated by the filler material 62 to the outer peripheral surface 28 of the sheath 24 in order to assist ignition of fuels which do not readily auto-ignite.

Compared to known planar heating filaments, the circumferentially symmetric arrangement of the heating filament 42 within the sheath 24 results in a more uniform or circumferentially symmetric distribution of heat (generated by the heating filament 42) onto the outer peripheral surface 28 of the sheath 24. The relatively finer pitch coils of the heating filament 42 concentrate the heat generated by the glow plug 12 at the free end portion of the heating element assembly 10. The relatively coarser pitch filament windings on the first end portion 54 of the heating filament 42 provide a relatively smooth temperature transition between the relatively straight electrical leads in the glow plug body 14 and the relatively finer pitch filament windings. Such transition helps ensure that there is not a sharp temperature gradient along the longitudinal axis of the heating element assembly 10.

Improved corrosion and oxidation resistance is provided by the protective sheath made from a carefully selected ceramic material. For example, 1 to 2 orders in magnitude of improved sodium corrosion resistance are obtained with alumina-based ceramic materials compared to silicon nitride based materials. Moreover, thermal shock resistance as well as strength is improved by reinforcing various ceramic materials with particulate material. Applicants' design methodology is advantageous for screening and selecting suitable materials for the sheath 24.

The improved heating element assembly may, for example, be incorporated in a glow plug which is continuously energized in an operating internal combustion engine to ensure ignition of relatively lower cetane number fuels. This design helps to protect glow plug heating element assemblies in a very severe environment so that they may experience a longer life than that experienced by previously known glow plug heating element assemblies. This improved heating element assembly may also be used other combustion applications, such as industrial furnaces, where a relatively durable surface-ignition element is required to initiate or assist combustion of fuels.

Other aspects, objects, and advantages of this invention can be obtained from a study of the drawings, the disclosure, and the appended claims.

We claim:

1. A heating element assembly adapted for a glow plug comprising:

a monolithic, refractory, corrosion-resistant, substantially-gas-impermeable, ceramic sheath, said sheath including a relatively-thin and annular wall having a closed end portion and defining a blind bore;

heating means for emitting heat, said heating means positioned in the blind bore of the sheath and adapted to be connected to a source of energy; and heat transfer means for transferring heat from the heating means to the sheath wherein the sheath and the heating means each have material properties and configurations which are selected in conjunction to prevent the maximum thermal and mechanical stresses in the sheath and the heating means from exceeding the minimum respective strengths of the materials forming the sheath and the heating means.

2. A heating element assembly adapted for a glow plug comprising:

a monolithic, refractory, corrosion-resistant, substantially-gas-impermeable, ceramic sheath, said sheath including a relatively-thin and annular wall having a closed end portion and defining a blind bore;

heating means for emitting heat, said heating means positioned in the blind bore of the sheath and adapted to be connected to a source of energy; and heat transfer means for transferring heat from the heating means to the sheath wherein said sheath and heating means each have a coefficient of thermal expansion, an outside diameter and a differential temperature between their respective operating and ambient temperatures wherein the product of the coefficient of thermal expansion, diameter, and differential temperature between operating and ambient temperature for the heating means is less than or equal to the product of the coefficient of thermal expansion, diameter, and differential temperature between operating and ambient temperature for the sheath.

3. A heating element assembly adapted for a glow plug comprising:

a monolithic, refractory, corrosion-resistant, substantially-gas-impermeable, ceramic sheath, said sheath including a relatively-thin and annular wall having a closed end portion and defining a blind bore;

heating means for emitting heat, said heating means positioned in the blind bore of the sheath and adapted to be connected to a source of energy; and heat transfer means for transferring heat from the heating means to the sheath wherein said sheath is substantially formed of a ceramic material selected from the group of aluminum titanate, beryllium oxide, titanium oxide, yttrium oxide, mullite, sodium zirconium phosphate, chromium oxide densified aluminum oxide, and reinforced aluminum oxide.

4. A heating element assembly adapted for a glow plug comprising:

a monolithic, refractory, corrosion-resistant, substantially-gas-impermeable, ceramic sheath, said sheath including a relatively-thin and annular wall having a closed end portion and defining a blind bore;

heating means for emitting heat, said heating means positioned in the blind bore of the sheath and adapted to be connected to a source of energy; and heat transfer means for transferring heat from the heating means to the sheath wherein said annular wall of the sheath has a maximum allowable thickness ($t_{max}$) governed by the following relationship:

$$t_{max} = \frac{(f)(MOR)(k)}{(\alpha)(E)(Q/A)}$$

wherein $t_{max}$ = maximum allowable thickness of annular wall of sheath in the direction of heat flux;

f = preselected factor greater than zero and equal to or less than one;

MOR = modulus of rupture of sheath;

k = thermal conductivity of sheath;

$\alpha$ = coefficient of thermal expansion of sheath;

E = modulus of elasticity of sheath; and

Q/A = heat flux.

5. The heating element assembly of claim 4 wherein said heating means includes an electrical resistance heating filament.

6. The heating element assembly of claim 5 wherein said heating means includes a mandrel formed of an electrically non-conductive rigid material, said mandrel positioned in the blind bore of the sheath in spaced relation to the annular wall of the sheath, said heating filament helically wound around the mandrel.

7. The heating element assembly of claim 6 wherein said mandrel has first and second end portions, said heating filament wound around the mandrel first end portion having a first preselected pitch ($P_1$), said heating filament wound around the mandrel second end portion having a second preselected pitch ($P_2$) smaller than the first pitch ($P_1$).

8. The heating element assembly of claim 6 wherein said mandrel is formed substantially of mullite.

9. The heating element assembly of claim 6 wherein said mandrel has an outer peripheral surface, said outer peripheral surface having first and second end portions, said second end portion of the mandrel having an end, said heating filament positioned in the blind bore of the sheath in spaced relation to the sheath, said heating filament having first and second end portions and an intermediate portion therebetween, said intermediate portion of the heating filament being positioned immediately adjacent the end of the second end portion of the mandrel, said first end portion of the heating filament being helically wound around the first end portion of the outer peripheral surface of the mandrel according to a first preselected pitch ($P_1$) said first end portion of the heating filament being helically wound around the second end portion of the outer peripheral surface of the mandrel according to a second preselected pitch ($P_2$) smaller than the first pitch ($P_1$), said second end portion of the heating filament extending between the second and first end portions of the mandrel in spaced relation to the sheath.

10. The heating element assembly of claim 9 herein said second end portion of the heating filament is helically wound around and in contact with the outer peripheral surface of the mandrel, said second and first end portions of the heating filament being spaced from one another and collectively forming a double helix, said double helix being helically wound around the second end portion of the mandrel according to an effective pitch which is about twice the second pitch, said double helix being helically wound around the first end portion of the mandrel according to an effective pitch which is about twice the first pitch.

11. The heating element assembly of claim 10 wherein said heating filament is a continuous single strand of wire.

12. The heating element assembly of claim 9 wherein said mandrel has a longitudinal bore, said second end portion of the heating filament extending through the mandrel bore between the second and first end portions of the mandrel.

13. The heating element assembly of claim 9 wherein said end of the second end portion of the mandrel defines a groove, said intermediate portion of the heating filament being positioned in the groove.

14. The heating element assembly of claim 9 wherein said first first pitch is about 9.44 windings per centimeter and said second preselected pitch is about 25.2 windings per centimeter.

15. The heating element assembly of claim 1 wherein said sheath is substantially formed of a composite ceramic oxide material.

16. The heating element assembly of claim 15 wherein said sheath is reinforced with particulate material.

17. The heating element assembly of claim 16 wherein said particulate material is a ceramic selected from the group of oxides, carbides, nitrides, and borides.

18. The heating element assembly of claim 15 wherein said sheath contains about 60 to 95% by volume of aluminum oxide and about 5 to 40% by volume of silicon carbide whiskers.

19. The heating element assembly of claim 1 wherein said heating means includes a helical electrical resistance heating filament positioned in the blind bore in direct circumferential contact with the inner peripheral surface of the annular wall of the sheath.

20. The heating element assembly of claim 19 wherein said helical electrical resistance heating filament is a first heating filament formed as a single helix, said heating means further including a second electrical resistance heating filament extending into the blind bore in radially-inwardly-spaced relation to the first heating filament and connected to the first heating filament adjacent to the closed end portion of the sheath.

21. The heating element assembly of claim 20 wherein said first and second heating filaments each have a cross-sectional area wherein the cross-sectional area of the first heating filament is less than the cross-sectional area of the second heating filament.

22. A heating element assembly adapted for a glow plug comprising:

a monolithic, refractory, corrosion-resistant, substantially-gas-impermeable, ceramic sheath, said sheath including a relatively-thin and annular wall having a closed end portion and defining a blind bore;

heating means for emitting heat, said heating means positioned in the blind bore of the sheath and adapted to be connected to a source of energy; and heat transfer means for transferring heat from the heating means to the sheath wherein said heating means includes an electrical resistance heating filament arranged as a double helix and positioned in the blind bore in direct contact with the inner peripheral surface of the annular wall.

23. A heating element assembly adapted for a glow plug comprising:

a monolithic, refractory, corrosion-resistant, substantially-gas-impermeable, ceramic sheath, said sheath including a relatively-thin and annular wall having a closed end portion and defining a blind bore;

heating means for emitting heat, said heating means positioned in the blind bore of the sheath and adapted to be connected to a source of energy; and heat transfer means for transferring heat from the heating means to the sheath wherein said heat transfer means includes an electrically non-conductive, refractory, and thermally-conductive filler material positioned in the blind bore between the heating means and the sheath, wherein said filler material is a cement formed substantially from calcium aluminate and water.

24. A heating element assembly adapted for a glow plug comprising:

a monolithic, refractory, corrosion-resistant, substantially-gas-impermeable, ceramic sheath, said sheath including a relatively-thin and annular wall having a closed end portion and defining a blind bore;

heating means for emitting heat, said heating means positioned in the blind bore of the sheath and adapted to be connected to a source of energy; and heat transfer means for transferring heat from the heating means to the sheath wherein said heat transfer means includes an electrically non-conductive, refractory, and thermally-conductive filler material positioned in the blind bore between the heating means and the sheath, wherein said filler material is a cement formed substantially from zirconium silicate and water.

25. A heating element assembly adapted for a glow plug comprising:

a monolithic, refractory, corrosion-resistant, substantially-gas-impermeable, ceramic sheath, said sheath including a relatively-thin and annular wall having a closed end portion and defining a blind bore;

heating means for emitting heat, said heating means positioned in the blind bore of the sheath and adapted to be connected to a source of energy; and heat transfer means for transferring heat from the heating means to the sheath wherein said heat transfer means includes an electrically non-conductive, refractory, and thermally-conductive filler material positioned in the blind bore between the heating means and the sheath, said filler material containing particulate means for increasing the thermal conductivity of the filler material.

26. The heating element assembly of claim 25

27. A heating element assembly adapted for a glow plug comprising:

a monolithic, refractory, corrosion-resistant, substantially-gas-impermeable, ceramic sheath, said sheath including a relatively-thin and annular wall having a closed end portion and defining a blind bore;

heating means for emitting heat, said heating means positioned in the blind bore of the sheath and adapted to be connected to a source of energy; and heat transfer means for transferring heat from the heating means to the sheath wherein said heat transfer means is provided by direct peripheral contact between the heating means and the annular wall of the sheath.

28. A heating element assembly adapted for a glow plug comprising:

a cylindrical monolithic, refractory, corrosion-resistant, substantially-gas-impermeable, ceramic sheath, said sheath including a relatively-thin and smooth annular wall having a closed end portion and defining a blind bore;

heating means for emitting heat, said heating means including a continuous single strand of electrical resistance wire positioned in the blind bore of the sheath and adapted to be connected to an electrical source of energy; and;

heat transfer means for transferring heat from the heating means to the sheath when the glow plug heating element assembly is electrically energized, said heat transfer means including a refractory thermally-conductive electrically non-conductive filler material positioned in the blind bore, said filler material containing particulate means for increasing the thermal conductivity of the filler material.

29. A heating element assembly adapted for a glow plug comprising:

a monolithic, refractory, corrosion-resistant, substantially-gas-impermeable, sheath, said sheath including a relatively-thin and annular wall having a closed end portion and defining a blind bore, said annular wall of the sheath having a maximum allowable thickness ($t_{max}$) governed by the following relationship:

$$t_{max} = \frac{(f)(MOR)(k)}{(\alpha)(E)(Q/A)}$$

wherein $t_{max}$=maximum allowable thickness of annular wall of sheath in the direction of heat flux, f=preselected factor greater than zero and equal to or less than one, MOR=modulus of rupture of sheath, k=thermal conductivity of sheath, $\alpha$=coefficient of thermal expansion of sheath, E=modulus of elasticity of sheath, and Q/A=heat flux;

heating means for emitting heat, said heating means positioned in the blind bore of the sheath and adapted to be connected to an electrical source of energy; and heat transfer means for transferring heat from the heating means to the sheath.

* * * * *

UNITED STATES PATENT AND TRADEMARK OFFICE

CERTIFICATE OF CORRECTION

PATENT NO. : 5,075,536

DATED : December 24, 1991

INVENTOR(S) : Towe, et al

It is certified that error appears in the above-identified patent and that said Letters Patent is hereby corrected as shown below:

On the title page:

In item [75] " Michael Blanco" should read --Michael M. Blanco--

On title page, OTHER PUBLICATIONS, delete, "U.S. application Ser. No. 07/386,064, titled: Interference Connection .....by Scott F. Shafer.";and On title page, OTHER PUBLICATIONS, delete, "U.S. application Ser. No. 07/524,609, titled: Heating Element Assembly for Flow Plug..... John M. Bailey et al."

Column 9, between lines 52 and 53:

after "Example No. 7 suggests that aluminum titanate ($Al_2TiO_5$) might be a promising material from the standpoint of surviving thermal stresses.", insert --However, it is deemed to be an unsuitable material for this application because it is not substantially gas impermeable (i.e., its porosity would simply allow corrosive combustion gases to pass through the sheath and attack the heating means 26) and also because its material properties become unstable at high temperatures.--

Col. 16, line 43 after "wires 18, 20, heating filament", delete "42 delta", and insert --42"--;

UNITED STATES PATENT AND TRADEMARK OFFICE

CERTIFICATE OF CORRECTION

PATENT NO. : 5,075,536

DATED : December 24, 1991

INVENTOR(S) : Towe, et al

It is certified that error appears in the above-identified patent and that said Letters Patent is hereby corrected as shown below:

Col. 16, line 46 after " the heating filament", delete "42,," and insert --42"--.

Col. 16, line 55 after "guide", delete "tub Rs Would" and insert --tubes would --;

Col. 17, line 1 after "center hole", insert --72--;

Col. 17, line 3 after "and then the", delete --screw--.
Col. 18, lines 29-68 and cols. 19-22, delete claims "1-29" and substitute the attached claims 1-37.

Signed and Sealed this

Thirteenth Day of September, 1994

*Attest:*

*Attesting Officer*

BRUCE LEHMAN

*Commissioner of Patents and Trademarks* connected lead wire 20. The tool 66 has a center hole 72 to accommodate the center lead wire 18. The filler material 62 is allowed to harden and then the tool 66 is carefully removed by unscrewing, leaving the closely wound coils of the heating filament 42" and a portion of the lead wire 20 embedded in the filler material 62. The center lead wire 18 is then inserted into the blind bore 34 and aligned along the longitudinal axis of the sheath 24. Additional filler material 62 is then inserted into the blind bore 34 to completely fill remaining voids in the blind bore 34.

In order to make a heating element assembly wherein the heating filament 42" and lead wire 20 are arranged as a double helix, a double-threaded screw would be substituted for the winding tool.

The first method of assembling the heating element assembly 10" of FIG. 4 is preferred because the coils of the heating filament 42" are positioned in direct contact with the sheath inner peripheral surface 36 which is expected to improve heat transfer from the heating means 26 to the sheath 24. The filler material is also easier to apply in this arrangement and it will be less subject to damage by subsequent steps of assembly.

The embodiment of FIG. 4 is believed to have the following advantages compared with the embodiments of FIGS. 1–2 or 3. First, the coils of the heating filament 42" are in direct contact with the inner peripheral surface 36 of the sheath 24. This direct contact provides more efficient heat transfer compared with filler material 62 as an interface. During assembly before the filler material 62 is added, the coils of the spring-like heating filament 42" expand against the inner peripheral surface 36 to more positively locate the position of the heating filament 42" within the sheath blind bore 34. Moreover, the coils can conform to irregularities which might be present on the inner peripheral surface 36. Second, the filler material 62 is easier to apply because there is more open space and opportunity for venting due to the absence of a mandrel. Third, the mandrel is entirely eliminated thereby eliminating some amount of cost.

In operation of the glow plug 12 shown in FIG. 1, electrical current flows into the lead wire 18, through the heating filament 42, and out through the lead wire 20. The relatively smaller diameter of the heating filament 42 creates relatively more electrical resistance in the heating filament than elsewhere in the electrical circuit and therefore generates heat. This heat is readily communicated by the filler material 62 to the outer peripheral surface 28 of the sheath 24 in order to assist ignition of fuels which do not readily auto-ignite.

Compared to known planar heating filaments, the circumferentially symmetric arrangement of the heating filament 42 within the sheath 24 results in a more uniform or circumferentially symmetric distribution of heat (generated by the heating filament 42) onto the outer peripheral surface 28 of the sheath 24. The relatively finer pitch coils of the heating filament 42 concentrate the heat generated by the glow plug 12 at the free end portion of the heating element assembly 10. The relatively coarser pitch filament windings on the first end portion 54 of the heating filament 42 provide a relatively smooth temperature transition between the relatively straight electrical leads in the glow plug body 14 and the relatively finer pitch filament windings. Such transition helps ensure that there is not a sharp temperature gradient along the longitudinal axis of the heating element assembly 10.

Improved corrosion and oxidation resistance is provided by the protective sheath made from a carefully selected ceramic material. For example, 1 to 2 orders in magnitude of improved sodium corrosion resistance are obtained with alumina-based ceramic materials compared to silicon nitride based materials. Moreover, thermal shock resistance as well as strength is improved by reinforcing various ceramic materials with particulate material. Applicants' design methodology is advantageous for screening and selecting suitable materials for the sheath 24.

The improved heating element assembly may, for example, be incorporated in a glow plug which is continuously energized in an operating internal combustion engine to ensure ignition of relatively lower cetane number fuels. This design helps to protect glow plug heating element assemblies in a very severe environment so that they may experience a longer life than that experienced by previously known glow plug heating element assemblies. This improved heating element assembly may also be used other combustion applications, such as industrial furnaces, where a relatively durable surface-ignition element is required to initiate or assist combustion of fuels.

Other aspects, objects, and advantages of this invention can be obtained from a study of the drawings, the disclosure, and the appended claims.

We claim:

1. A heating element assembly adapted for a glow plug comprising:

a monolithic, refractory, corrosion-resistant, substantially-gas-impermeable, ceramic sheath, said sheath including a relatively-thin and annular wall having a closed end portion and defining a blind bore;

heating means for emitting heat, said heating means positioned in the blind bore of the sheath and adapted to be connected to a source of energy; and heat transfer means for transferring heat from the heating means to the sheath.

2. The heating element assembly of claim 1 wherein the sheath and the heating means each have material properties and configurations which are selected in conjunction to prevent the maximum thermal and mechanical stresses in the sheath and the heating means from exceeding the minimum respective strengths of the materials forming the sheath and the heating means.

3. The heating element assembly of claim 1 wherein said sheath and heating means each have a coefficient of thermal expansion, an outside diameter and a differential temperature between their respective operating and ambient temperatures wherein the product of the coefficient of thermal expansion, diameter, and differential temperature between operating and ambient temperature for the heating means is less than or equal to the product of the coefficient of thermal expansion, diameter, and differential temperature between operating and ambient temperature for the sheath.

4. The heating element assembly of claim 1 wherein said annular wall of the sheath has a maximum allowable thickness ($t_{max}$) governed by the following relationship:

$$t_{max} = \frac{(f)(MOR)(k)}{(\alpha)(E)(Q/A)}$$

wherein $t_{max}$ = maximum allowable thickness of annular wall of sheath in the direction of heat flux;

f = preselected factor greater than zero and equal to or less than one;

MOR = modulus of rupture of sheath;

k = thermal conductivity of sheath;

α = coefficient of thermal expansion of sheath;

E = modulus of elasticity of sheath; and Q/A = heat flux.

5. The heating element assembly of claim 1 wherein said annular wall of the sheath includes an inner peripheral surface defining the blind bore and a substantially-smooth outer peripheral surface.

6. The heating element assembly of claim 1 wherein said sheath is electrically nonconductive.

7. The heating element assembly of claim 1 wherein said sheath is substantially formed of a ceramic oxide material.

8. The heating element assembly of claim 1 wherein said sheath is substantially formed of a composite ceramic oxide material.

9. The heating element assembly of claim 8 wherein said sheath is reinforced with particulate material.

10. The heating element assembly of claim 9 wherein said particulate material is a ceramic selected from the group of oxides, carbides, nitrides, and borides.

11. The heating element assembly of claim 8 wherein said sheath contains about 60 to 95% by volume of aluminum oxide and about 5 to 40% by volume of silicon carbide whiskers.

12. The heating element assembly of claim 1 wherein said sheath is substantially formed of a ceramic material selected from the group of aluminum oxide, beryllium oxide, titanium oxide, yttrium oxide, mullite, sodium zirconium phosphate, and chromium oxide densified aluminum oxide.

13. The heating element assembly of claim 1 wherein said heating means includes an electrical resistance heating filament.

14. The heating element assembly of claim 13 wherein said heating means includes a mandrel formed of an electrically non-conductive rigid material, said mandrel positioned in the blind bore of the sheath in spaced relation to the annular wall of the sheath, said heating filament helically wound around the mandrel.

15. The heating element assembly of claim 14 wherein said mandrel has first and second end portions, said heating filament wound around the mandrel first end portion having a first preselected pitch, said heating filament wound around the mandrel second end portion having a second preselected pitch smaller than the first pitch.

16. The heating element assembly of claim 15 wherein said mandrel is formed substantially of mullite.

17. The heating element assembly of claim 16 wherein said mandrel has an outer peripheral surface, said outer peripheral surface having first and second end portions, said second end portion of the mandrel having an end, said heating filament positioned in the blind bore of the sheath in spaced relation to the sheath, said heating filament having first and second end portions and an intermediate portion therebetween, said intermediate portion of the heating filament being positioned immediately adjacent the end of the second end portion of the mandrel, said first end portion of the heating filament being helically wound around the first end portion of the outer peripheral surface of the mandrel according to a first preselected pitch, said first end portion of the heating filament being helically wound around the second end portion of the outer peripheral surface of the mandrel according to a second preselected pitch smaller than the first pitch, said second end portion of the heating filament extending between the second and first end portions of the mandrel in spaced relation to the sheath.

18. The heating element assembly of claim 15 wherein said second end portion of the heating filament is helically wound around and in contact with the outer peripheral surface of the mandrel, said second and first end portions of the heating filament being spaced from one another and collectively forming a double helix, said double helix being helically wound around the second end portion of the mandrel according to an effective pitch which is about twice the second pitch, said double helix being helically wound around the first end portion of the mandrel according to an effective pitch which is about twice the first pitch.

19. The heating element assembly of claim 18 wherein said heating filament is a continuous single strand of wire.

20. The heating element assembly of claim 17 wherein said mandrel has a longitudinal bore, said second end portion of the heating filament extending through the mandrel bore between the second and first end portions of the mandrel.

21. The heating element assembly of claim 17 wherein said end of the second end portion of the mandrel defines a groove, said intermediate portion of the heating filament being positioned in the groove.

22. The heating element assembly of claim 17 wherein said first first pitch is about 9.44 windings per centimeter and said second preselected pitch is about 25.2 windings per centimeter.

23. The heating element assembly of claim 1 wherein said heating means includes a helical electrical resistance heating filament positioned in the blind bore in direct circumferential contact with the inner peripheral surface of the annular wall of the sheath.

24. The heating element assembly of claim 23 wherein said helical electrical resistance heating filament is a first heating filament formed as a single helix, said heating means further including a second electrical resistance heating filament extending into the blind bore in radially-inwardly-spaced relation to the first heating filament and connected to the first heating filament adjacent to the closed end portion of the sheath.

25. The heating element assembly of claim 24 wherein said first and second heating filaments each have a cross-sectional area wherein the cross-sectional area of the first heating filament is less than the cross-sectional area of the second heating filament.

26. The heating element assembly of claim 1 wherein said heating means includes an electrical resistance heating filament arranged as a double helix and positioned in the blind bore in direct contact with the inner peripheral surface of the annular wall.

27. The heating element assembly of claim 1 wherein said heating means includes a helical heating filament positioned in the blind bore in radially-spaced relation to the inner peripheral surface of the annular wall of the sheath.

28. The heating element assembly of claim 1 wherein said heat transfer means is electrically non-conductive.

29. The heating element assembly of claim 28 wherein said heat transfer means includes a refractory thermally-conductive filler material positioned in the blind bore between the heating means and the sheath.

30. The heating element assembly of claim 29 wherein said filler material is a cement formed substantially from calcium aluminate and water.

31. The heating element assembly of claim 29 wherein said filler material is a cement formed substantially from zirconium silicate and water.

32. The heating element assembly of claim 29 wherein said filler material is formed substantially from magnesium oxide powder.

33. The heating element assembly of claim 29 wherein said filler material contains particulate means for increasing the thermal conductivity of the filler material.

34. The heating element assembly of claim 33 wherein said particulate means includes particulates selected from the group of silicon carbide, platinum, and molybdenum.

35. The heating element assembly of claim 1 wherein said heat transfer means is provided by direct peripheral contact between the heating means and the annular wall of the sheath.

36. A heating element assembly adapted for a glow plug comprising:

a cylindrical monolithic, refractory, corrosion-resistant, substantially-gas-impermeable, ceramic sheath, said sheath including a relatively-thin and smooth annular wall having a closed end portion and defining a blind bore;

heating means for emitting heat, said heating means including a continuous single strand of electrical resistance wire positioned in the blind bore of the sheath and adapted to be connected to an electrical source of energy; and heat transfer means for transferring heat from the heating means to the sheath when the glow plug heating element assembly is electrically energized, said heat transfer means including a refractory thermally-conductive electrically non-conductive filler material positioned in the blind bore.

37. A heating element assembly adapted for a glow plug comprising:

a monolithic, refractory, corrosion-resistant, substantially-gas-impermeable, sheath, said sheath including a relatively-thin and annular wall having a closed end portion and defining a blind bore, said annular wall of the sheath having a maximum allowable thickness ($t_{max}$) governed by the following relationship:

$$t_{max} = \frac{(f)(MOR)(k)}{(\alpha)(E)(Q/A)}$$

wherein $t_{max}$ = maximum allowable thickness of annular wall of sheath in the direction of heat flux, f = preselected factor greater than zero and equal to or less than one, MOR = modulus of rupture of sheath, k = thermal conductivity of sheath, $\alpha$ = coefficient of thermal expansion of sheath, E = modulus of elasticity of sheath, and Q/A = heat flux;

heating means for emitting heat, said heating means positioned in the blind bore of the sheath and adapted to be connected to an electrical source of energy; and heat transfer means for transferring heat from the heating means to the sheath.

* * * * *